United States Patent [19]

Matsui et al.

[11] Patent Number: 4,821,015

[45] Date of Patent: Apr. 11, 1989

[54] VARIABLE RESISTOR

[75] Inventors: Kenji Matsui; Toshi Numata; Yukinori Ueda; Tomohisa Ogawa; Kiyoshi Ito, all of Nagaokakyo, Japan

[73] Assignee: Murata Manufacturing Co., Ltd., Kyoto, Japan

[21] Appl. No.: 128,913

[22] Filed: Dec. 4, 1987

[51] Int. Cl.[4] ..... H01C 10/34

[52] U.S. Cl. ..... 338/175; 338/172; 338/162

[58] Field of Search ..... 338/175, 174, 172, 162, 338/177, 183, 328

[56] References Cited

U.S. PATENT DOCUMENTS 4,184,140 1/1980 Frey Jr. et al. ..... 338/174

*Primary Examiner*—E. A. Goldberg
*Assistant Examiner*—M. M. Lateef
*Attorney, Agent, or Firm*—Wenderoth, Lind & Ponack

[57] ABSTRACT

A variable resistor of a type for mounting against the surface of a printed circuit substrate, the variable resistor having:

an insulating substrate having one surface for supporting a resistor and an opposite surface for being positioned against the surface of a printed circuit substrate;

a curved resistor on the one surface of the insulating substrate and having opposite ends;

a sliding member rotatably mounted on the insulating substrate and sliding on the resistor;

a plurality of outside electrodes on the insulating substrate, one for each end of the curved resistor, and extending from the corresponding end of the resistor along the one surface of the insulating substrate, along an edge of the insulating substrate, and along the opposite surface of the insulating substrate, each outside electrode having a three layer structure constituted by a lower layer against the insulating substrate, a middle layer and an outer layer, the lower layer being an electrically conductive material suitable for plating, the middle layer being a plating material having the capability to improve the heat resisting characteristics of solder by acting as a barrier to migration of the material of the lower layer into the outer layer, and the outer layer being a material having superior soldering characteristics.

5 Claims, 2 Drawing Sheets

VARIABLE RESISTOR

BACKGROUND OF THE INVENTION

The present invention relates to a variable resistor the resistance value of which is variable by rotating a sliding member on a resistor formed on an insulating substrate and capable of being mounted on a surface of a printed circuit substrate and the like, and in particular to a construction of outside electrodes provided on the insulating substrate.

A variable resistor of this type, in which an arched thermet resistor 5 is formed on an upper surface of an insulating substrate 1 and a sliding member (not shown) is rotatably mounted on the insulating substrate 1 so as to slide on the resistor 5, as shown in FIG. 9, has been proposed. The sliding member is rotatably mounted in a central hole 2 of the insulating substrate 1 through an electrode (not shown).

In addition, the resistor 5 is provided with outside electrodes 6 formed of silver-palladium alloy at both ends thereof. These outside electrodes 6 are formed by at first printing silver-palladium alloys 6*a*, 6*b* on the one surface and the opposite surface of the insulating substrate 1 and then printing the same silver-palladium alloy 6*c* on end faces, as shown in FIG. 10. Subsequently, the resistor 5 is printed on the outside electrodes 6.

However, in the above described variable resistor in order to prevent silver from diffusing in the solder and to improve the heat-resisting characteristics of the solder, a silver-palladium alloy is used for the electrodes 6 but this is expensive and a problem occurs in that it is impossible also to surely prevent silver from reaching the solder. In addition, the film-thickness of the silver-palladium alloy 6*c* provided on the end faces can not but be increased and glass frits are exposed on the surface to spoil the soldering characteristics, whereby a problem occurs also in that a troublesome preliminary soldering is required.

OBJECTS OF THE INVENTION

Accordingly, it is an object of the present invention to provide a variable resistor capable of surely preventing silver forming outside electrodes from reaching solder during the soldering of the outside electrodes to improve the heat-resistance of the solder.

It is another object of the present invention to provide a variable resistor which does not always require an expensive silver-palladium alloy for the formation of outside electrodes.

It is a further object of the present invention to provide a variable resistor which does not require a troublesome preliminary soldering during the soldering of outside electrodes and which can use even a eutectic solder.

It is a still further object of the present invention to provide a variable resistor in which the outside electrodes can be easily formed.

DETAILED DESCRIPTION OF THE INVENTION

Figure 1:
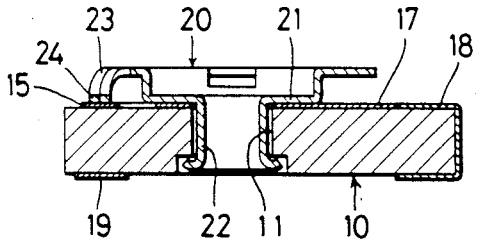
FIG. 1 is a central sectional view of a first example of a variable resistor according to the present invention.

The first example of the present invention is shown in FIGS. 1 to 5.

This variable resistor comprises an insulating substrate 10 and a sliding member 20 provided on one surface of said insulating substrate 10.

The insulating substrate 10 is obtained by forming and sintering alumina, having a central hole 11, and provided with an arched thermet resistor 15 and an annular collector electrode 17 formed on the one surface thereof.

Both end portions of said resistor 15 and said collector electrode 17 extend to one end portion of the substrate 10 to be electrically connected with outside electrodes 16 and 18 which will be described in detail later.

Figure 2:
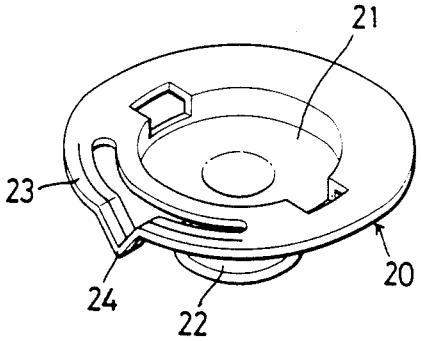
FIG. 2 is a perspective view showing a sliding member in the variable resistor shown in FIG. 1.
Figure 3:
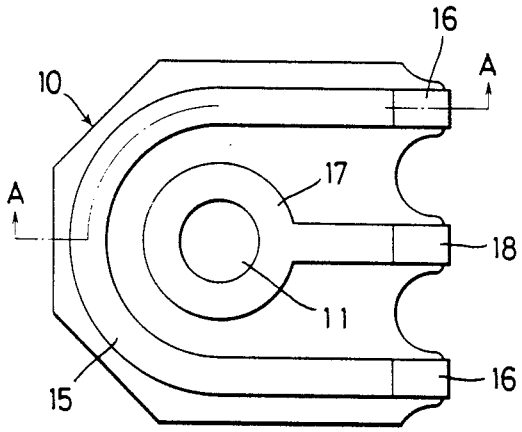
FIG. 3 is a plan view showing an insulating substrate in the variable resistor shown in FIG. 1.
Figure 4:
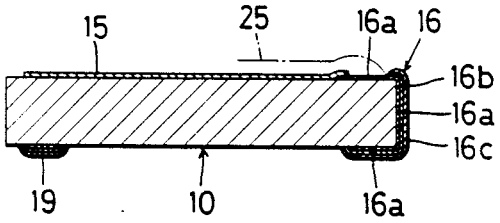
FIG. 4 is a sectional view of FIG. 3 taken along the arrow A—A thereof and showing outside electrodes in detail.
Figure 5:
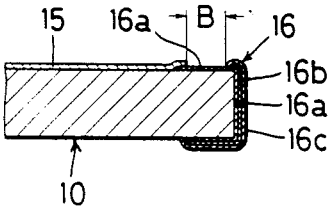
FIG. 5 is a sectional view of outside electrodes in another example in detail.

The sliding member 20 is provided with a dish-like portion 21, a cylindrical portion 22 at a central portion and an arched portion 23 on a peripheral portion, as shown in FIG. 2. This sliding member 20 is rotatably mounted by inserting the cylindrical portion 22 in the central hole 11 of the insulating substrate 10 and flanging the cylindrical portion 22 over the opposite surface so that the dish-like portion 21 is brought into contact with a surface of the electrode 17 and a contacting point portion 24 projecting below the arched portion 23 is brought into contact with a surface of the resistor 15.

Nextly, the construction of the electrodes 16 is described.

The outside electrodes 16 comprises a lower layer 16*a*, a first plated layer (middle layer) 16*b* and a second plated layer (upper layer) 16*c*. The lower layer 16*a* is obtained by printing silver or silver-palladium alloy on the one surface and printing silver on the opposite surface and end faces. The thickness of the lower layer 16*a* is for example 15 microns. The first plated layer 16*b* is formed of nickel or nickel alloy and is for example 2 microns thick. The second plated layer 16*c* is formed of tin or tin-lead alloy and for example 4 microns thick.

The first plated layer 16*b* serves as a barrier for preventing silver from reaching said upper layer 16*c* and has an effect of improving heat-resisting characteristics of the solder. The second plated layer 16*c* has an effect of heightening the solder-wetting property to improve the soldering characteristics and an effect of eliminating the necessity of the preliminary soldering.

Accordingly, even though silver is used for the lower layer, silver can be surely prevented from reaching the second plated layer to improve the heat-resisting characteristics of the solder and it can be formed without always using expensive silver-palladium alloy as the electrode. In addition, the upper layer has an effect of improving the soldering characteristics, whereby the troublesome preliminary soldering can be omitted and even eutectic solder can be used, and as a result, the cost of production can be reduced as a whole.

In the manufacture of the outside electrodes 16, at first the lower layer 16*a* is formed on the one surface, the opposite surface and the end faces of the insulating substrate 10 which and contacting the resistor 15. Subsequently, a plating resist 25 (shown by a dotted chain line in FIG. 4) is applied on the resistor 15 and remains during the formation of the first plated layer 16*b* and the second plated layer 16*c* and then, the plating resist 25 is removed.

On the other hand, also the outside electrode 18 of the collector electrode 17 has a three-layer structure similarly to said outside electrodes 16. In addition, reference numeral 19 in FIG. 1 designates an idle electrode. Also said idle electrode 19 has the same three-layer electrode structure as that of the outside electrodes 16.

In addition, the material of which the plated layers 16*b*, 16*c* are formed is not limited to the described materials. Various kinds of material capable of improving the heat-resisting characteristics of the solder can be used for the plated layer 16*b* and various kinds of material superior in soldering characteristic can be used for the plated layer 16*c*.

In said manufacturing process of the outside electrodes 16, when the plating resist 25 is applied extending from the resistior 15 to the upper surface of the lower layer 16*a* to form the first plated layer 16*b* and the second plated layer 16*c*, a gap B is formed between the resistor 15 and the plated layers 16*b* and 16*c*.

If the gap B is formed between the resistor 15 and the plated layers 16*b* and 16*c* in such a manner, the characteristics of the resistor 15 can be prevented from deterioration due to the presence of by the plated layers 16*b* and 16*c* and a plated layer is surely prevented from being formed on the resistor 15, so that the plated layer formed on the resistor 15 can be prevented from separating during the use of the variable resistor to bring about a short-circuit and the like.

In addition, since an end edge of the plating resist 25 engages on the lower layer 16*a* with good adhesion, the resistor 15 can be completely protected from plating.

Figure 6:
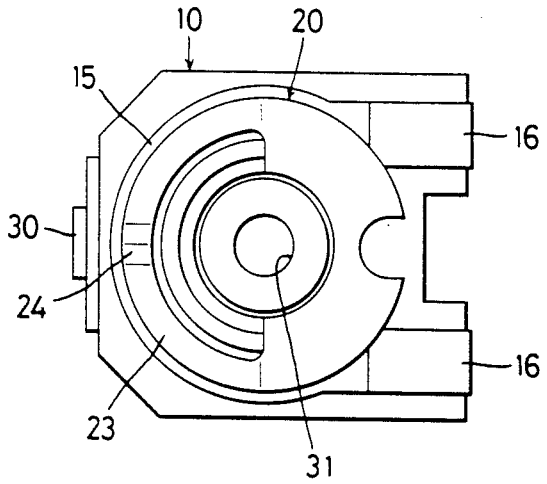
FIG. 6 is a plan view of a second example of a variable resistor according to the present invention.
Figure 7:
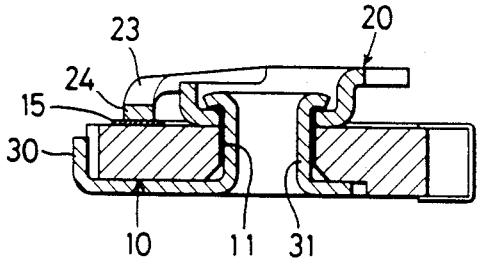
FIG. 7 is a central sectional view of the second example of a variable resistor according to the present invention shown in FIG. 6.
Figure 8:
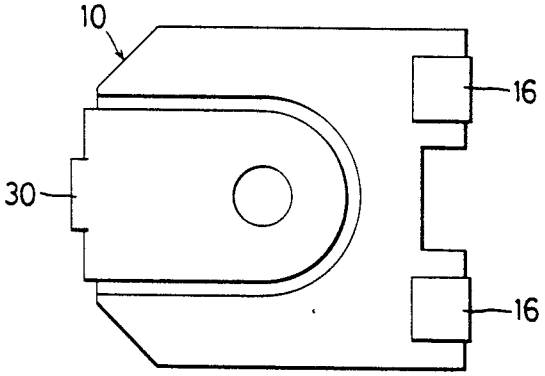
FIG. 8 is a bottom view showing the second example of a variable resistor according to the present invention shown in FIG. 6.
Figure 9:
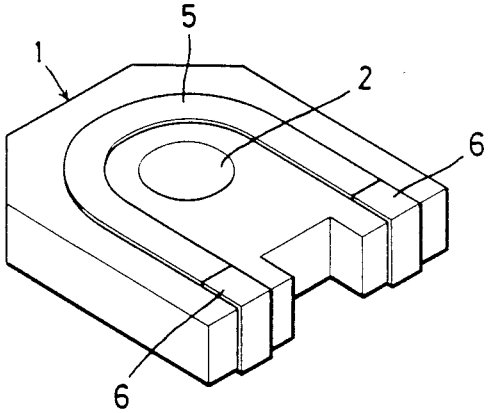
FIG.9 PRIOR ART
FIG. 9 is a perspective view showing an insulating substrate in a conventional variable resistor.
Figure 10:
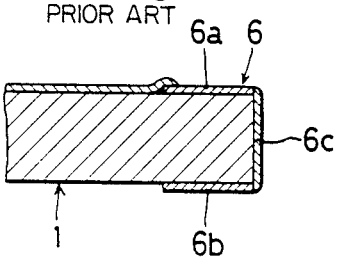
FIG.10 PRIOR ART
FIG. 10 is a sectional view of outside electrodes in the conventional variable resistor.

FIGS. 6 to 8 show a second example of the pesent invention.

In this variable resistor, an electrode 30 is provided in place of the collector electrode in the variable resistor shown in FIG. 1 and a cylindrical portion 31 thereof is inserted into the central hole 11 of the insulating substrate 10 and the sliding member 20 is rotatably mounted by flanging over an upper portion of said cylindrical portion 31. Outside electrodes 16 of a thermet resistor 15 have a three-layer structure similar to said first example.

We claim:

1. A variable resistor of a type for mounting against the surface of a printed circuit substrate, said variable resistor comprising:

an insulating substrate having one surface for supporting a resistor and an opposite surface for being positioned against the surface of a printed circuit substrate;

a curved resistor on said one surface of said insulating substrate and having opposite ends;

a sliding member rotatably mounted on said insulating substrate and sliding on said resistor;

a plurality of outside electrodes on said insulating substrate, one for each end of said curved resistor, and extending from the corresponding end of the resistor along the one surface of said insulating substrate, along an edge of said insulating substrate, and along the opposite surface of said insulating substrate, each outside electrode having a three layer structure constituted by a lower layer against said insulating substrate, a middle layer and an outer layer, the lower layer being an electrically conductive material suitable for plating, the middle layer being a plating material having the capability to improve the heat resisting characteristics of solder by acting as a barrier to migration of the material of the lower layer into the outer layer, and the outer layer being a material having superior soldering characteristics.

2. A variable resistor as set forth in claim 1, in which said lower layer is formed of silver.

3. A variable resistor as set forth in claim 1, in which said middle layer is formed of nickel or nickel alloys.

4. A variable resistor as set forth in claim 1, in which said upper layer is formed of tin or tin-lead alloys.

5. Variable resistor as claimed in claim 1 in which said middle layer and said outer layer end at a point spaced along said outer electrode from the corresponding end of said curved resistor to provide a gap in said middle and outer layers between said layers and the corresponding end of said curved resistor and extending along said lower layer.

* * * * *